US010194746B2

(12) United States Patent
Salvoni et al.

(10) Patent No.: US 10,194,746 B2
(45) Date of Patent: Feb. 5, 2019

(54) SEAT TILTING MECHANISM WITH TWO SPRINGS

(71) Applicant: Posturite Limited, Berwick (GB)

(72) Inventors: Paolo Salvoni, Castegnato (IT); Massimiliano Cernetig, Castegnato (IT)

(73) Assignee: Posturite Limited, Berwick (GB)

( * ) Notice: Subject to any disclaimer, the term of this patent is extended or adjusted under 35 U.S.C. 154(b) by 0 days.

(21) Appl. No.: 15/634,900

(22) Filed: Jun. 27, 2017

(65) Prior Publication Data

US 2017/0367485 A1 Dec. 28, 2017

(30) Foreign Application Priority Data

Jun. 28, 2016 (GB) ..... 1611216.1

(51) Int. Cl.
*A47C 3/00* (2006.01)
*A47C 1/032* (2006.01)
*A47C 7/44* (2006.01)

(52) U.S. Cl.
CPC ..... *A47C 1/03272* (2013.01); *A47C 1/03266* (2013.01); *A47C 7/441* (2013.01); *A47C 7/443* (2013.01)

(58) Field of Classification Search
CPC ..... A47C 1/03255; A47C 1/03266; A47C 1/03272; A47C 7/46; A47C 3/026; A47C 7/443
USPC ..... 297/300.1–300.8, 303.4, 303.5; 267/168, 267/131
See application file for complete search history.

(56) References Cited

U.S. PATENT DOCUMENTS 3,417,956 A * 12/1968 Helms ..... A47C 3/026 248/576
3,637,174 A * 1/1972 Kuo ..... F16L 3/2053 248/542
4,652,050 A * 3/1987 Stevens ..... A47C 3/026 297/302.4
5,026,117 A * 6/1991 Faiks ..... A47C 3/026 267/131
5,397,165 A * 3/1995 Grin ..... A47C 1/03255 297/300.5
5,551,674 A * 9/1996 Johnsen ..... B60G 17/021 267/168
5,909,924 A * 6/1999 Roslund, Jr. ..... A47C 1/03255 297/300.4

(Continued)

FOREIGN PATENT DOCUMENTS

DE 3930983 3/1991
GB 2119641 11/1983

(Continued)

*Primary Examiner* — Shin H Kim
(74) *Attorney, Agent, or Firm* — Levy & Grandinetti

(57) ABSTRACT

A seat tilting mechanism comprising a main body, a support member rotationally mounted to said main body, and a first extension coil spring mounted between said main body and said support member to provide resistance to rotation of said support member, in which said seat tilting mechanism further comprises a second extension coil spring and an engagement mechanism which engages said second extension coil spring for resistance to rotation of said support member when said first extension coil spring reaches a pre-determined point of extension.

20 Claims, 2 Drawing Sheets

(56) References Cited

U.S. PATENT DOCUMENTS

| | | | | |
|---|---|---|---|---|
| 6,086,153 | A * | 7/2000 | Heidmann | A47C 1/023 297/300.1 |
| 6,283,548 | B1 | 9/2001 | Husemann | |
| 6,340,207 | B1 * | 1/2002 | Brightbill | A47C 3/025 297/258.1 |
| 2007/0057552 | A1 * | 3/2007 | Roslund | A47C 1/03222 297/292 |
| 2007/0057553 | A1 * | 3/2007 | Roslund | A47C 1/03238 297/300.2 |
| 2008/0001453 | A1 * | 1/2008 | Rutman | A47C 1/03255 297/300.4 |
| 2012/0161483 | A1 * | 6/2012 | Hayashi | A47C 1/03238 297/300.2 |
| 2013/0175839 | A1 | 7/2013 | Park | |
| 2014/0125104 | A1 * | 5/2014 | Hasegawa | A47C 1/023 297/303.4 |
| 2017/0079435 | A1 * | 3/2017 | Donati | A47C 1/032 |
| 2017/0367484 | A1 * | 12/2017 | Salvoni | A47C 1/03255 |
| 2017/0367485 | A1 * | 12/2017 | Salvoni | A47C 1/03272 |

FOREIGN PATENT DOCUMENTS

| | | |
|---|---|---|
| JP | 2003189963 | 7/2003 |
| WO | WO 2009/153811 | 12/2009 |

* cited by examiner

SEAT TILTING MECHANISM WITH TWO SPRINGS

The present invention relates to a seat tilting mechanism, for use particularly, but not exclusively, with office chairs.

Office chairs and the like are commonly provided with a number of separate adjustment mechanisms. These may include mechanisms to adjust the height of the seat, the height of the backrest in relation to the seat, the lateral position of the seat in relation to the backrest, the tilt position of the seat and the tilt position of the backrest. In addition, such chairs are also often provided with backrests and/or seats which can tilt in use as the chair is sat on. In order to provide for this functionality a seat tilting mechanism is provided which facilitates the rotational movement, and provides some kind of resistance to tilting to provide a level of user control and comfort.

Commonly a resistance coil spring is utilised to provide the necessary resistance to tilting. The spring is mounted between a main body of the seat tilting mechanism and a support member of some kind which is rotationally mounted to the main body, and to which the backrest or seat is mounted. The spring extends as the support member is rotated by the user, and controls its movement.

However, one problem with seat tilting mechanisms like this is that the force applied to the support member by the user can increase the further it is rotated. In particular, a user's weight applied to a backrest increases the further their torso rotates away from vertical. As such, the control a resistance coil spring can provide may decrease the further back a backrest is tilted by a user relying on their own weight. If the resistance coil spring is too weak to support the user, the backrest may tilt back uncontrollably the further round it goes. However, if a stronger resistance coil spring is used to combat this, it may have the result that it becomes too difficult for a lighter user to push the backrest away from vertical initially, and/or to maintain the backrest at a comfortable degree of tilt without it rotating back up again.

The present invention is intended to overcome some of the above problems.

Therefore, according to the present invention a seat tilting mechanism comprises a main body, a support member rotationally mounted to said main body, and a first extension coil spring mounted between said main body and said support member to provide resistance to rotation of said support member, and in which said seat tilting mechanism further comprises a second extension coil spring and an engagement mechanism which engages said second extension coil spring for resistance to rotation of said support member when said first extension coil spring reaches a pre-determined point of extension.

Thus, the present invention provides a resistance to rotation which increases at said pre-determined point of extension because the second coil spring is utilised beyond that point. It will be appreciated that the particular point of extension this occurs can be chosen by the skilled person to suit the application in question. For example, if a backrest is mounted to the support member the pre-determined point of extension of the first coil spring can coincide with a backrest angle at which user's above a particular weight would exert sufficient force on the first extension coil spring to extend it at too great a rate.

Further, it will also be appreciated that the strength of the first and second coil springs can be chosen by the skilled person to suit the application. As mentioned above, the additional resistance provided by the second coil spring over the first can be chosen to prevent a backrest from over-rotating under a user's weight, but in addition to this, the first coil spring can be chosen so a backrest can be initially easier for a user to rotate away from vertical. In effect, the strengths of the first and second coil springs can be balanced to provide an enhanced level of control to the user at all rotational positions of a backrest.

It will be appreciated that the second coil spring can be mounted independently of the first, and the engagement mechanism can involve a physical part of the first coil spring or the support member physically engaging the second coil spring. All that is required is that the second coil spring is mounted between the main body and the support member, and is engaged to be placed under extension at the pre-determined point of extension of the first coil spring. However, preferably the seat tilting mechanism can comprise an extension resistance mechanism comprising a first end part, a second end part and the first coil spring and second coil spring can be mounted between the first end part and the second end part. As such, the first and second coil springs are associated with one another at least in as much as they are both mounted between the first and second end parts of the extension resistance mechanism.

Preferably the second coil spring can comprise an axially extending spacer member mounted to a first end thereof. The engagement mechanism can then comprise a first radially extending portion provided at a first end of the spacer member and a second radially extending portion provided on the first end part. The second radially extending portion can engage the first radially extending portion when the first extension coil spring reaches said pre-determined point of extension. With this arrangement the movement apart of the first and second end parts when the first coil spring extends brings the second radially extending portion towards, and then into engagement with, the first radially extending portion, thereby to engage the second coil spring.

The first and second coil springs can be arranged alongside one another, but in a preferred embodiment the second coil spring can be co-axial with the first extension coil spring. Furthermore, the second coil spring can be mounted inside the first coil spring. This is a compact and ergonomic configuration.

The spacer member can comprise a sleeve with an annular flange at a first end, and the first end part can comprise a ring mounted around the sleeve, which abuts against the flange when the first coil spring reaches the pre-determined point of extension.

In addition, to provide further stability to the whole extension resistance mechanism, the first end part can comprise a rod arranged inside the sleeve for telescoping movement in relation thereto.

It will be appreciated that the extension resistance mechanism can be mounted either way up between the main body and the support member. However, preferably the first end part can be mounted to the support member and the second end part can be mounted to the main body.

The support member can be any rotating part of a seat tilting mechanism which rotates in relation to the main body. In one version of the invention the support member can comprise a seat support, such that the extension resistance mechanism controls the rotational position of a seat mounted to the seat support. In another version of the invention the support member can comprise a backrest support, such that the extension resistance mechanism controls the rotational position of a backrest mounted to the backrest support.

One particular type of known seat adjustment mechanism mechanically connects the tilt of the backrest to the tilt of the seat. The amount of angular movement of the backrest and the seat can be the same, but typically such mechanisms are configured so the backrest rotates more than the seat. As such, the further back a user tilts the backrest, the more relaxed the seating position becomes. The resistance to tilting can be provided by a spring applied to the backrest, but in addition to this, it is also known to configure mechanisms of this kind so a resistance to tilting of the backrest is also provided by the weight of the user sat on the seat. A particularly effective system of this kind uses a quadrilateral hinge between the seat and a main body of the mechanism, which is configured so the seat rises as it rotates back. This means the weight of the user is continuously utilised as a resistance as the backrest rotates rearward. However, an issue with mechanisms of this kind is that the seat rises in relation to the backrest, causing so-called "shirt pull" as the user's clothing is drawn downwards.

In order to address the above problems, WO2009/153811 to CO.FE.MO S.P.A., discloses an adjustment device for chairs comprising a main body, a prop element mounted above the main body for carrying a seat, a backrest mounted to the main body, and an articulation means for movably engaging the backrest and the prop element to the main body, which comprises a lever hinged to the main body at a first mounting site and having at least two lever portions hinged to the prop element at a second mounting site and to the backrest at a third mounting site respectively, so as to obtain a given movement relationship between the backrest and the prop element. A first swinging arm is hinged to the main body and to the prop element, and a second swinging arm is hinged to the main body and to the backrest. The first swinging arm defines together with the lever, the prop element and the main body a first hinged quadrilateral, and the second swinging arm defines together with the lever, the backrest and the main body a second hinged quadrilateral. Therefore, the quadrilateral hinge which controls the movement of the seat is linked to a quadrilateral hinge which controls the synchronous movement of the backrest. This allows for a more ergonomic synchronous movement of the seat and backrest which can reduce the "shirt pull" effect.

However, the device disclosed in WO2009/153811 suffers from a number of drawbacks. Firstly, the first and second quadrilateral hinges are configured such that an angular displacement ratio of the backrest in relation to the prop element is about 5 to 1. In other words, the backrest rotates five times as much as the prop element. As such, the further back the user rotates the backrest the more relaxed the seating position becomes. It has been found that an angular displacement ratio of this kind is bad for a user's back, as undue pressure is placed on the lower spine the further the angle of a user's hips opens up.

The rotation of the prop element is determined by the interior angles and lengths of each side of the first quadrilateral hinge. The first mounting site and an inner end of the first swinging arm where it is hinged to the main body are fixed, so the rotation of the prop element in relation to the main body is determined by the difference between the degree and kind of movement of the second mounting site about the first mounting site, and degree and kind of movement of an outer end of the first swinging arm about the inner end thereof.

The degree and kind of movement in each case is determined by two factors. Firstly, the distance between the second mounting site and the first mounting site, and between the outer end and the inner end of the first swinging arm respectively, will determine just how far the second mounting site and the outer end of the first swinging arm will travel when the first quadrilateral hinge is moved. Secondly, the planetary position of the second mounting site about the first mounting site, and the planetary position of the outer end of the first swinging arm about the inner end respectively, will determine whether they rise or fall, as well as how much, when the first quadrilateral hinge is moved. It is the relationship between the respective positions of the second mounting site and the outer end of the first swinging arm at any position of the first quadrilateral hinge which determine the angel the prop element assumes at that moment.

The same characteristics apply to the second quadrilateral hinge, and the respective positions of the third mounting site in relation to the first mounting site, and an outer end of the second swinging arm in relation to an inner end thereof, are configured to achieved the desired angular displacement ratio of the backrest in relation to the prop element.

In WO2009/153811, in order to provide the angular displacement ratio of the backrest in relation to the prop element of 5 to 1, the angle of the second and third mounting sites about the first mounting site is about 140 degrees, and the distance between the first and second mounting site is shorter than that between the first and third mounting sites. What is achieved here is a small degree of rotation of the prop element and a large degree of rotation of the backrest. It also means that the lever is relatively compact, as it comprises a significant bend about the first mounting site.

However, if one wants to provide an angular displacement ratio of the backrest in relation to the prop element of about 2 to 1, then the angle of the second and third mounting sites about the first mounting site needs to be about 170 degrees, and the distance between the first and second mounting sites needs to be greater than in the prior art. This would create technical problems with the arrangement shown in WO2009/153811 because the resistance coil spring is mounted to the second mounting site. This is an advantageously simple construction if the lever is shaped like that in WO2009/153811, but with a larger angle between the second and third mounting sites, and a greater distance between the first and second mounting sites, a correspondingly longer coil spring would be required to reach up to that point, which adds costs and complexity.

Further, mounting the resistance coil spring to the second mounting site places that hinge under undue lateral loadings. In addition, it also means that the axis of the spring is always aligned with its direction of extension. This means that the resistance provided by the spring is in accordance with its degree of extension. This may be desired in some circumstances, but it prevents a greater or lesser resistance being provided at particular points in the rotational movement of the backrest. This is disadvantageous because the weight a user places on the backrest may increase exponentially the greater the angle of tilt, and it may therefore be out of phase with a linear increase in resistance provided by the spring. As such, the rate at which the backrest rotates backwards may increase as it does so, which may not be desired.

In order to address these particular problems the Applicant's co-pending patent application discloses a seat tilting mechanism comprising a main body, a seat support, a backrest support and an articulation mechanism, in which said articulation mechanism comprises a lever rotationally mounted at a midpoint thereof to said main body, and comprising a first portion rotationally mounted at an upper point of said lever to said seat support, and a second portion rotationally mounted at a lower point of said lever to said backrest support, in which said articulation mechanism comprises a first arm, a first end of which is rotationally mounted to said main body and a second end of which is rotationally mounted to said seat support, said first arm defining with said first portion, said seat support and said main body a first quadrilateral hinge, in which said articulation mechanism comprises a second arm, a first end of which is rotationally mounted to said main body and a second end of which is rotationally mounted to said backrest support, said second arm defining with said second portion, said backrest support and said main body a second quadrilateral hinge, in which interior corner angles and lengths of each side of said first quadrilateral hinge, and interior corner angles and lengths of each side of said second quadrilateral hinge are such that a predetermined angular displacement ratio of said backrest support in relation to said seat support is provided, in which an extension resistance device is mounted between said main body and said first portion to provide resistance to rotation of said lever, in which a first end of said extension resistance device is rotationally mounted to said lever at a first mounting point located between said midpoint and said upper point, and in which said first mounting point is angularly displaced from a line extending between said midpoint and said upper point.

Thus, with the invention of the Applicant's co-pending patent application the first end of the extension resistance device is mounted to the lever at a different location to the upper point. This allows a number of advantages over the prior art. Firstly, if it is desired to provide an angular displacement ratio of the backrest support in relation to the seat support of about 2 to 1, and as such the angle of the upper and lower points about the midpoint is about 170 degrees, the extension resistance device can be mounted below the upper point, and it can therefore be considerably shorter. Whatismore, the first mounting point can also be disposed below the level of the seat support, which makes the whole mechanism far more compact than the prior art, in which the equivalent mounting point has to be level with the seat support because it is coincident with the upper point hinged thereto.

Further, as the extension resistance device is mounted to the lever at a different location to the upper point, the hinge provided at the upper point is not placed under direct lateral loadings. This may increase its operational lifespan.

In addition, the axis of the extension resistance device is misaligned with the direction of extension, because the first mounting point and the upper point are displaced from one another. As such these two points have different planetary movement paths about the midpoint, which are not aligned with one another. The first mounting point can be positioned so its planetary movement path crosses that of the upper point, and therefore aligns the axis of the extension resistance device with the direction of extension, at a desired angle of tilt of the backrest support. This can be towards the end of the rotation of the backrest support, so the resistance provided by the extension resistance device effectively increases at a greater rate than it would were its axis aligned with the direction of extension. This allows for a greater degree of compensation against the exponential increase in the weight a user places on the backrest the greater the angle of tilt. The further back the user leans the backrest, the closer the axis of the coil spring gets to the direction of extension.

However, it has been found that using a single extension coil spring between the main body and the first portion in a mechanism of this kind does not provide an optimal degree of compensation against the exponential increase in the weight a user places on the backrest the greater the angle of tilt. However, using the arrangement of the present invention does help to address this problem, and to provide such a seat tilt mechanism with a greater degree of usability and control.

Therefore, in one version of the present invention the support member can comprise a lever rotationally mounted at a midpoint thereof to the main body, and can comprise a first portion rotationally mounted at an upper point of the lever to a seat support, and a second portion rotationally mounted at a lower point of the lever to a backrest support. The seat tilting mechanism can comprise an articulation mechanism comprising a first arm, a first end of which can be rotationally mounted to the main body and a second end of which can be rotationally mounted to the seat support, the first arm defining with the first portion, the seat support and the main body a first quadrilateral hinge. Further, the articulation mechanism can comprise a second arm, a first end of which can be rotationally mounted to the main body and a second end of which can be rotationally mounted to the backrest support, the second arm defining with the second portion, the backrest support and the main body a second quadrilateral hinge. Corner angles and lengths of each side of the first quadrilateral hinge, and interior corner angles and lengths of each side of the second quadrilateral hinge can be such that a predetermined angular displacement ratio of the backrest support in relation to the seat support is provided. The extension resistance mechanism can be mounted between the main body and the first portion to provide resistance to rotation of the lever. The first end part can be rotationally mounted to the lever at a first mounting point located between the midpoint and the upper point, and the first end part can be angularly displaced from a line extending between the midpoint and the upper point.

All the ergonomic benefits of this particular kind of seat tilting mechanism are as explained above, when referring to the Applicant's co-pending patent application.

The first quadrilateral hinge can be movable between a rest position in which the seat support can be substantially horizontal, and a fully tilted position in which the seat support can be angularly displaced from horizontal. The second end part of the extension resistance mechanism can be rotationally mounted to the main body at a second mounting point, and the first mounting point can be located such that a rotation angle between an axis of the extension resistance mechanism and a line extending between the second mounting point and the upper point (which is effectively the direction of extension) decreases as the first quadrilateral hinge moves from the rest position towards the fully tilted position.

Preferably the first coil spring can reach the pre-determined point of extension before the above described rotation angle reaches zero. What this means is that the greater resistance to extension provided by the second coil spring is brought to bear before the rotation angle reaches zero, and the first and second coil springs are directly aligned with the direction of extension, and thereby provide their greatest level of effectiveness. This can be arranged to be in the vicinity of the most common tilt angles in use, so the greatest control is provided.

In addition to this, the first mounting point can be located such that the rotation angle is zero prior to the first quadrilateral hinge achieving the fully tilted position. In other words the rotation angle can go past zero and a rotation angle in the opposite direction can grow between the axis of the extension resistance mechanism and the line between the second mounting point and the upper point. This arrangement allows for the increase in resistance provided as the axis of the extension resistance mechanism approaching the line extending between the second mounting point and the upper point to be more beneficially located in a region of tilt most used in use.

As explained above, the angle achieved by the seat support as the first quadrilateral hinge is moved is determined by the interior angles and lengths of each side of the first quadrilateral hinge. The midpoint and the second end of the first arm are fixed, so the rotation of the seat support in relation to the main body is determined by the difference between the degree and kind of movement of the upper point about the midpoint, and the degree and kind of movement of the first end of the first arm about the second end thereof. Furthermore, the angle achieved by the backrest support as the second quadrilateral hinge is moved is determined by the interior angles and lengths of each side of the second quadrilateral hinge. The midpoint and the second end of the second arm are fixed, so the rotation of the backrest support in relation to the main body is determined by the difference between the degree and kind of movement of the lower point about the midpoint, and the degree and kind of movement of the first end of the second arm about the second end thereof.

In one construction the interior corner angles and lengths of each side of the first quadrilateral hinge, and the interior corner angles and lengths of each side of the second quadrilateral hinge are such that the predetermined angular displacement ratio of the backrest support in relation to the seat support is greater than one to one and less than two to one, and in one embodiment it is substantially 1.9 to one.

Two embodiments of the present invention will now be described by way of example, and with reference to the accompanying drawings in which.

Figure 1:
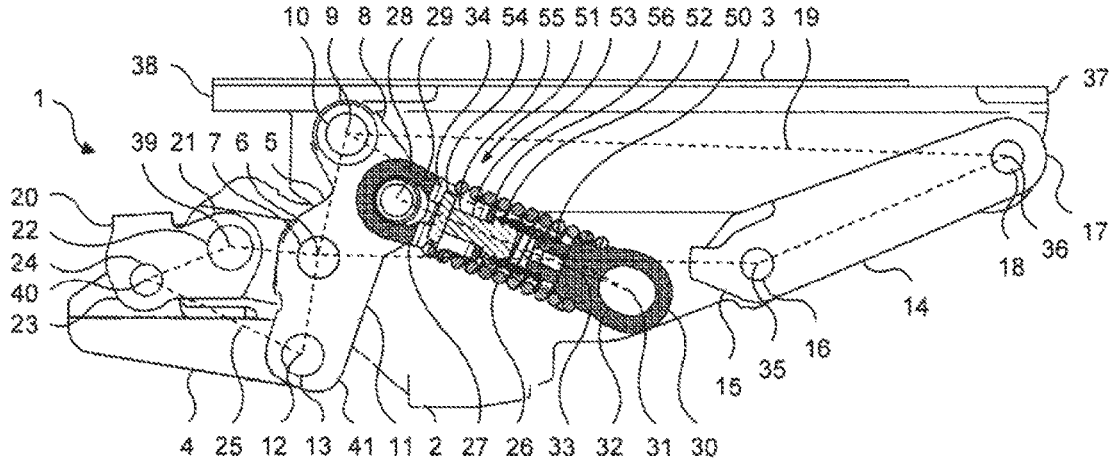
FIG. 1 is a side view of a first seat tilting mechanism according to the present invention in a rest position.

Referring to FIG. 1, a seat tilting mechanism 1 comprises a main body 2, a support member in the form of lever 5 rotationally mounted to the main body 2, and a first extension coil spring 26 mounted between the main body 2 and the support member 5 to provide resistance to rotation of the support member 5. The seat tilting mechanism 1 further comprises a second extension coil spring 50 and an engagement mechanism, generally designated 51, which engages the second extension coil spring 50 for resistance to rotation of the support member 5 when the first extension coil spring 26 reaches a pre-determined point of extension.

Figure 4:
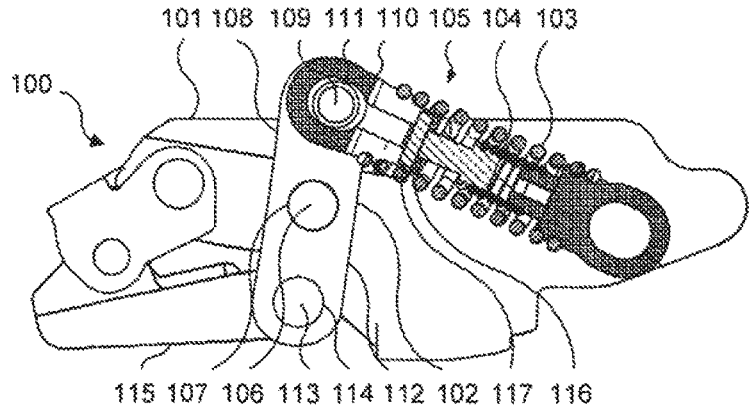

The seat tilting mechanism 1 incorporates the articulation mechanism invention of the Applicant's co-pending patent application, and the following description includes a detailed explanation of the workings of that mechanism, including how the first coil spring 26 and second coil spring 50 are incorporated within it. A second embodiment of the invention which does not feature the complex articulation mechanism of the Applicant's co-pending patent application is shown in FIG. 4 to illustrate how the present invention can also be used in a more traditional seat tilting mechanism.

Referring to FIG. 1, the seat tilting mechanism 1 comprises a seat support 3, a backrest support 4 and an articulation mechanism. The articulation mechanism comprises the lever 5 rotationally mounted at a midpoint 6 by annular hinge 7 to the main body 2, and comprising a first portion 8 rotationally mounted at an upper point 9 by annular hinge 10 to the seat support 3, and a second portion 11 rotationally mounted at a lower point 12 by annular hinge 13 to the backrest support 4.

The articulation mechanism further comprises a first arm 14, a first end 15 of which is rotationally mounted to the main body 2 by annular hinge 16, and a second end 17 of which is rotationally mounted to said seat support 3 by annular hinge 18. The first arm 14 defines with the first portion 8, the seat support 3 and the main body 2 a first quadrilateral hinge, indicated by hashed box 19. The articulation mechanism comprises a second arm 20, a first end 21 of which is rotationally mounted to the main body 2 by annular hinge 22, and a second end 23 of which is rotationally mounted to the backrest support 4 by annular hinge 24. The second arm 20 defines with the second portion 11, the backrest support 4 and the main body 2 a second quadrilateral hinge, indicated by hashed box 25.

As described further below, interior corner angles and lengths of each side of the first quadrilateral hinge 19, and interior corner angles and lengths of each side of the second quadrilateral hinge 25 are such that a predetermined angular displacement ratio of the backrest support 4 in relation to the seat support 3 is provided.

An extension resistance mechanism comprising first coil spring 26 and second coil spring 50, is mounted between the main body 2 and the first portion 8 to provide resistance to rotation of the lever 5. The components of the extension resistance mechanism are shown in the Figures in cross-section for ease of explanation. The extension resistance mechanism also comprises a first end part 27 and a second end part 30, between which the first coil spring 26 and the second coil spring 50 are mounted. The first end part 27 is rotationally mounted to the lever 5 at a first mounting point 28 by annular hinge 29, which first mounting point 28 is located between the midpoint 6 and the upper point 9. As is clear from FIG. 1, the first mounting point 28 is angularly displaced from a line (the rightmost side of hashed box 19) extending between the midpoint 6 and the upper point 9. The second end part 30 is rotationally mounted to the main body 2 at a second mounting point 31 by annular hinge 32.

As will be appreciated from the Figures, the second coil spring 50 is co-axial with the first coil spring 26, and it is mounted inside the first coil spring 26.

The second coil spring 50 comprises an axially extending spacer member mounted to a first end 52 thereof, in the form of sleeve 53. This has a first radially extending portion in the form of an annular flange 54 at a first end 55 thereof. The first end part 27 has a corresponding second radially extending portion in the form of ring 56, which is mounted around the sleeve 53. With this arrangement the movement apart of the first end part 27 and the second end part 30 when the first coil spring 26 extends brings the ring 56 towards, and then into engagement with, the flange 54. The ring 56 abuts against the flange 54 when the first coil spring 26 reaches the pre-determined point of extension, as explained further below.

In addition, the first end part 27 comprises a rod 57 (visible in FIG. 2) which is arranged inside the sleeve 53 for telescoping movement in relation thereto. This provides the engagement mechanism 50 with greater stability in use.

Figure 3:
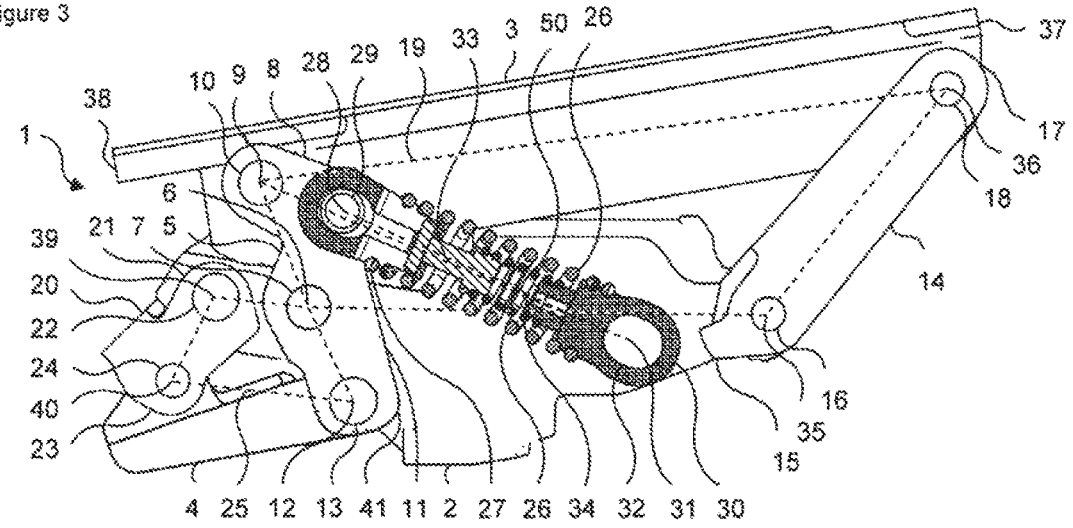
FIG. 3 is a side view of the seat tilting mechanism as shown in FIG. 1 in a fully tilted position; and, FIG. 4 is a side view of a second seat tilting mechanism according to the present invention.

The seat tilting mechanism 1 is adapted for use in an office chair, and provides a user-adjustable tilting movement thereto by virtue of being able to move between a rest position as shown in FIG. 1, in which the seat support 3 and the backrest support 4 are substantially horizontal, and a fully tilted position as shown in FIG. 3 in which the seat support 3 and the backrest support 4 are angularly displaced from horizontal. The main body 2 is adapted to rest atop an upright stanchion (not shown), the seat support 3 is adapted to support a seat (not shown) arranged generally horizontally above it, and the backrest support 4 is adapted to support a backrest (not shown) arranged generally vertically above it. The various components of the seat tilting mechanism 1 are constructed from metal. The various annular hinges are of a known construction, and allow the various components to freely rotate in relation to one another in either direction.

The seat tilting mechanism 1 has a number of features designed to provide control over the way it can move between the rest position to the fully tilted position, and in particular to increase the resistance to tilting the greater the level of tilt. This is relevant in the context of seat tilting mechanism 1 because the force which moves it is provided by the user themselves, and it increases the further the seat tilting mechanism 1 is tilted, because the user's weight is increasingly brought to bear on the mechanism.

Initially, if the user places all their weight on the seat support 3, the seat tilting mechanism 1 will assume the rest position shown in FIG. 1. It is biased into this position because the upper point 9 is forward of the midpoint 6, and therefore weight applied to the upper point 9 serves to force it in a clockwise direction about the midpoint 6, thereby closing the first quadrilateral hinge 19. However, once the user starts to lean back and places some of their weight on the backrest support 4, a rotational force is applied to the lower point 12 to move it in an anti-clockwise direction about the midpoint 6. This force acts to open the first quadrilateral hinge 19 against the combined tensile force of the first coil spring 26 and the rest of the user's weight bearing down on the upper point 9. The rotational force applied to the lower point 12 must reach a break out point at which it exceeds the combined tensile force of the first coil spring 26 and the rest of the user's weight bearing down on the upper point 9, before the first quadrilateral hinge 19 will start to open. It will be appreciated that this will vary depending on the weight of the user.

What is relevant is that as the first quadrilateral hinge 19 opens up and moves from the rest position shown in FIG. 1 towards the fully tilted position shown in FIG. 3, the rotational force applied to the lower point 12 exponentially increases because the user is being rotated backwards, so their weight gradually shifts from acting on the seat support 3 to acting on the backrest support 4. The user can obviously compensate for this by adjusting their body position as the seat tilting mechanism 1 moves, for example by leaning forward slightly when the seat tilting mechanism 1 reaches a desired angle. However, the extension resistance mechanism made up of the first coil spring 26 and the second coil spring 50 functionally compensates for this because the force required to extend it increases with the length of extension. This is because a) the force required to extend the first coil spring 26 and the second coil spring 50 increases the more they extend by virtue of the fact they are extension coil springs, b) the second coil spring 50 is introduced part way through the tilting action to increase the level of resistance offered, and c) an axis 33 of both the first coil spring 26 and second coil spring 50 is initially angularly displaced from a line 34 extending between the second mounting point 31 and the upper point 9, which is effectively the direction of extension.

Figure 2:
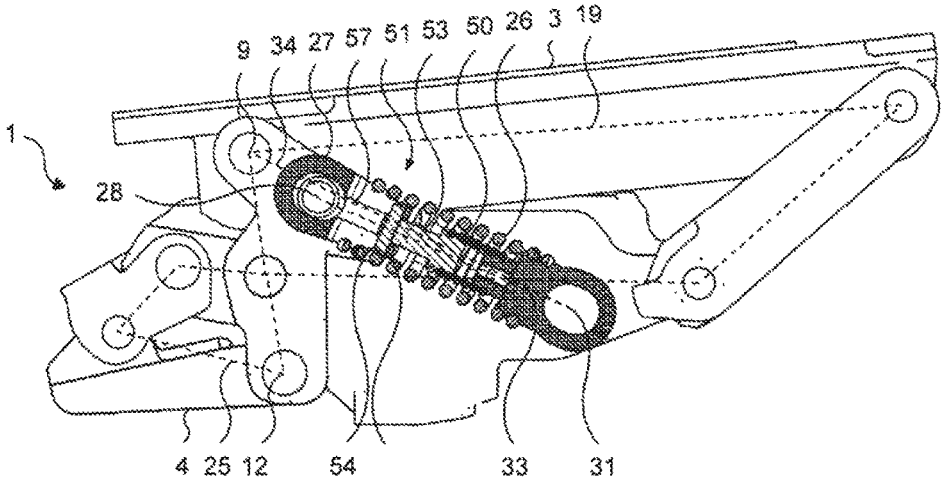
FIG. 2 is a side view of the seat tilting mechanism as shown in FIG. 1 in a mid-tilt position.

In the context of the present invention the most relevant of these three factors is the function of the second coil spring 50, and the engagement mechanism 51 which employs the second coil spring 50 at the pre-determined point of extension of the first coil spring 26. In particular, from the rest position shown in FIG. 1 to the mid-tilt position shown in FIG. 2, the resistance to tilt is provided only by the first coil spring 26. As such, the resistance is at a lower level. This means that moving the seat tilting mechanism 1 from the rest position shown in FIG. 1 to the mid-tilt position shown in FIG. 2 is easier for the user to perform. In particular the necessary rotational force which has to be applied to the lower point 12 to reach the break out point at which it exceeds the combined tensile force of the first coil spring 26 and the rest of the user's weight bearing down on the upper point 9 is lower than it would be if a larger single coil spring were used instead of first coil spring 26. This makes the seat tilting mechanism 1 more comfortable to use.

However, once the first coil spring 26 has reached the pre-determined point of extension, as shown in FIG. 2, the ring 56 abuts against the flange 54 and the first end part 27 engages the second coil spring 50. Therefore, from this mid-tilt position to the fully tilted position shown in FIG. 3, the resistance to tilt is provided by both the first coil spring 26 and the second coil spring 50. This means that moving the seat tilting mechanism 1 from the position shown in FIG. 2 to that shown in FIG. 3 is harder than moving it from the position shown in FIG. 1 to that shown in FIG. 2. This is advantageous because as explained above the rotational force applied to the lower point 12 exponentially increases the further the user leans back, because their weight continues to shift from acting on the seat support 3 to acting on the backrest support 4. The extra resistance provided by the second coil spring 50 helps to prevent, or at least mitigate against, an uncontrollable increase in the rate of tilting rotation after the mid-tilt position shown in FIG. 2.

With regard to the axial position of the first coil spring 26 and second coil spring 50, in the rest position shown in FIG. 1 the axis 33 of the first coil spring 26 and second coil spring 50 is angularly displaced from the line 34. However, as will be appreciated from the Figures, the first mounting point 28 is located such that the rotation angle between the axis 33 and the line 34 decreases as the first quadrilateral hinge 19 moves from the rest position towards the fully tilted position. This is because the mounting point 28 has a different planetary movement path about the midpoint 6 to that of the upper point 9. The result achieved is that the increasing resistance provided by the first coil spring 26, and then also the second coil spring 50, as they extend has an increasing impact on the first quadrilateral hinge 19 as it moves from the rest position as shown in FIG. 1 to the fully tilted position shown in FIG. 3. This is because the axis 33 of the first and second coil springs 26 and 50 is brought closer and closer to the actual direction of extension. As such the resistance provided by the first coil spring 26, and then also the second coil spring 50, increases as the first quadrilateral hinge 19 moves towards the fully tilted position to a greater extent that it would if axis 33 of the first and second coil springs 26 and 50 was always aligned in the direction of extension.

The combination of the introduction of the second coil spring 50 part way through the tilting process and the angular movement of the first coil spring 26 and the second coil spring 50 towards the direction of extension through the tilting process means that to the user the sensation is that substantially the same amount of force is required from them to tilt the seat whatever its angle of tilt. In particular, it is not harder to initiate the tilting action than to continue with it, and it does not become uncomfortably easier to tilt the seat the more tilted it becomes. These are undesirable features of known seat tilting mechanisms. It will be appreciated that the beneficial effects of the present arrangement will vary depending on the weight of the user, but the intention is to generate a feeling of control and comfort for most average sized users.

As will be appreciated from FIG. 3, the first mounting point 28 is located such that the axis 33 of the first coil spring 26 aligns with the line 34 prior to the first quadrilateral hinge 19 achieving the fully tilted position. As such, in FIG. 3 the axis 33 is now angularly displaced from opposite side of the line 34. What this means is that the above described increase in resistance provided as a result of the axis 33 of the first and second coil springs 26 and 50 approaching and then meeting the line 34 is beneficially located in a region of tilt more likely to be used by a user, which is prior to the fully tilted position. This makes this increase in resistance more useful.

It will also be appreciated from FIG. 2, that the predetermined point of extension of the first coil spring 26 occurs just before the axis 33 of the first and second coil spring 26 and 50 aligns with the line 34. What this means is that the second coil spring 50 is effective in a region of tilt more likely to be used by a user, which extends from the mid-tilt position shown in FIG. 2 to the point the axis 33 of the first and second coil spring 26 and 50 aligns with the line 34. Again, this is the region of tilt most likely to be used by a user.

The first quadrilateral hinge 19 comprises four corners, namely midpoint 6, upper point 9, a centre 35 of the annular hinge 16, and a centre 36 of annular hinge 18, and it moves by virtue of the annular hinges 7, 10, 16 and 18 at those corners. The lengths of each side of the first quadrilateral hinge 19 are clear from the Figures, and the interior corner angles of the first quadrilateral hinge 19 when the seat tilting mechanism 1 is in the rest position are shown in FIG. 1. These interior corner angles change as the first quadrilateral hinge 19 moves, and FIG. 3 shows them when the seat tilting mechanism 1 is in the fully tilted position.

The important characteristics of the first quadrilateral hinge 19 are firstly the greater distance between centres 35 and 36, than between midpoint 6 and upper point 9. This means that as the first quadrilateral hinge 19 moves, a front 37 of the seat support 3 rises in relation to a rear 38 thereof, and hence the seat support 3 rotates. Secondly, throughout the entire movement range of the first quadrilateral hinge 19 the centre 36 is forward of the centre 35, which means that as the first quadrilateral hinge 19 moves from the rest position shown in FIG. 1 to the fully tilted position shown in FIG. 3, the front 37 of the seat support 3 continuously rises as the centre 36 follows its planetary path about the centre 35. Thirdly, the planetary movement path the upper point 9 follows about the midpoint as the first quadrilateral hinge 19 moves from the rest position shown in FIG. 1 to the fully tilted position shown in FIG. 3 sees it initially rise, but then fall, as it passes over centre. This means that the rear 38 of the seat support 3 initially rises slightly, but then it falls. These different movements of the centre 36 and the upper point 9, mean that the rate at which the seat support 3 rotates increases the further the first quadrilateral hinge 19 moves from the rest position to the fully tilted position. This makes for a more comfortable seating experience for the user because the angle of tilt can be more precisely controlled at first.

It will also be appreciated that as the first quadrilateral hinge 19 moves from the rest position to the fully tilted position the seat support 3 moves rearwardly. This ensures that the seat and backrest parts (not shown) supported by the seat tilting mechanism 1 do not move laterally apart from one another as the user tilts the backrest back. Once again, this makes for a more comfortable seating experience.

The second quadrilateral hinge 25 comprises four corners, namely midpoint 6, lower point 12, a centre 39 of the annular hinge 22, and a centre 40 of the annular hinge 24, and it moves by virtue of the annular hinges 7, 13, 22 and 24 at those corners. The lengths of each side of the second quadrilateral hinge 25 are clear from the Figures, and the interior corner angles of the second quadrilateral hinge 25 when the seat tilting mechanism 1 is in the rest position are shown in FIG. 1. These interior corner angles change as the second quadrilateral hinge 25 moves, and FIG. 3 shows them when the seat tilting mechanism 1 is in the fully tilted position.

The second quadrilateral hinge 25 shares similar characteristics to the first quadrilateral hinge 19. It is inverted relative to the first quadrilateral hinge 19, but the spatial relationship between centres 40 and 39 is like that between centres 36 and 35, in that centre 40 is always rearward of centre 39, so it continuously falls during movement of the second quadrilateral hinge 25 from the rest position to the fully tilted position. Further, the spatial relationship between the midpoint 6 and the lower point 12 is like that between the midpoint 6 and the upper point 9, in that the lower point 12 initially falls as the second quadrilateral hinge 25 begins its movement from the rest position to the fully tilted position, but it then rises as its planetary movement path about the midpoint 6 passes over centre. As such, a front 41 of the backrest support 4 initially falls slightly, but then it rises. Once again, these different movements of the centre 40 and the lower point 12, mean that the rate at which the backrest support 4 rotates increases the further the second quadrilateral hinge 25 moves from the rest position to the fully tilted position. This works in conjunction with the similar rotation rate characteristic of the seat support 3 to make for a more comfortable seating experience for the user.

It will also be appreciated that as the second quadrilateral hinge 25 moves from the rest position to the fully tilted position the backrest support 4 moves forward. This also serves to ensure that the seat and backrest parts (not shown) supported by the seat tilting mechanism 1 do not move laterally apart from one another as the user tilts the backrest back.

However, the most important characteristic of the second quadrilateral hinge 25 is that it is configured to rotate the backrest support 4 more than the first quadrilateral hinge 13 is configured to rotate the seat support 3. The angular displacement ratio between the backrest support 4 and the seat support 3 is 1.9 to one. This is achieved because centre 39 is closer to midpoint 6 than it is to centre 40, which results in a greater angular change in the shape of the second quadrilateral hinge 25 than is achieved by the first quadrilateral hinge 25, where centre 35 is closer to centre 36 than it is to midpoint 6.

As is clear from the Figures, the first portion 8 of the lever 5 is L shaped, with the first mounting point 28 located at the corner of the L shape. This is a compact and efficient arrangement.

The seat tilting mechanism 1 operates as follows. When no user is seated on the office chair incorporating the seat tilting mechanism 1 it adopts the rest position shown in FIG. 1. This is due to the force of the first coil spring 26 acting to rotate the first portion 8 of the lever 5 about the midpoint 6. The first coil spring 26 comprises a sufficient tensile force to lift the backrest (not shown) back up into its generally vertical position by levering the lower point 12 clockwise about the midpoint 6.

When a user sits on the seat (not shown) mounted to the seat support 3, their weight acts to maintain the seat tilting mechanism 1 in the rest position, because the upper point 9 is forward of the midpoint 6, and therefore weight applied to the upper point 9 serves to force it in a clockwise direction about the midpoint 6, thereby closing the first quadrilateral hinge 19.

The user can lean back against the backrest (not shown) mounted to the backrest support 4 without the seat tilting mechanism 1 moving from the rest position as shown in FIG. 1, provided the force applied by the user is less than a break out point at which it exceeds the combined forces of the first coil spring 26 and the rest of the user's weight bearing down on the upper point 9.

To force the office chair into a more relaxed seating position the user simply leans back against the backrest. Once the weight applied to the backrest exceeds the break out point, the first and second quadrilateral hinges 19 and 25 will start to move from the rest position to the fully tilted position. The rate at which this movement occurs will depend on the amount of force applied by the user, and they will be able to increase or decrease the rate by adjusting their body position accordingly. However, the force required to initiate the tilting action, and to move the seat tilting mechanism from the rest position to the mid-tilt position shown in FIG. 2 is small because the user only needs to act against the strength of the first coil spring 26. If a single coil spring were used in place of the first and second coil springs 26 and 50, it would have to be equal in strength to the combined resistive strength of the first and second coil springs 26 and 50 towards the end of the tilting process. As such, it would exert a greater resistance to tilting from the rest position to the mid-tilt position, making it harder for the user to tilt the seat initially. In fact, the use of the dual spring arrangement of the invention allows for an easy and comfortable initial tilting action.

As the angular displacement ratio between the seat support 3 and the backrest support 4 is 1.9 to one, the backrest will rotate more than the seat, creating a more relaxed relationship between backrest and seat the more the seat tilting mechanism 1 moves towards the fully tilted position.

Further, due to the relative positions of the upper point 9 and the lower point 12 about the midpoint 6, and in particular the fact that they initially travel upwards and downwards respectively, before travelling downwards and upwards respectively, the rate at which the seat and backrest rotate increases the further the seat tilting mechanism 1 moves towards the fully tilted position. This makes for a more comfortable seating experience.

In addition, once the seat tilting mechanism 1 reaches the mid-tilt position as shown in FIG. 2, the resistance to tilt increases to counteract the increase in the driving force applied by the user as they shift more weight onto the backrest support 4. This extra resistance provided by the second coil spring 50 helps to prevent, or at least mitigate against, an uncontrollable increase in the rate of tilting rotation after the mid-tilt position shown in FIG. 2. Once again, this makes for a more comfortable seating experience.

In addition, due to the location of the first mounting point 28, the resistance to tilting also increases the further the seat tilting mechanism 1 moves towards the fully tilted position by virtue of the axis 33 of the first and second coil springs 26 and 50 moving closer to the direction of extension. This also compensates for the exponential increase in weight a user places on the backrest the further they tilt it back. Furthermore, this beneficial increase in resistance is applied in a middle region of tilt most used, which is prior to the fully tilted position.

If the user leans forward, and transfers their weight back again from the backrest to the seat, the seat tilting mechanism 1 will move back towards the rest position as shown in FIG. 1. If the user gets up from the office chair, the seat tilting mechanism 1 will return to the rest position as described above.

Of note is the fact that the contraction force applied decreases as the angle of tilt decreases, because the second coil spring 50 no longer acts on the lever 5 after the mid-tilt position, and because the axis 33 of the first and second coil springs 26 and 50 rotates away from the direction of contraction. This means that when the seat tilting mechanism 1 returns to the rest position this is done in a controlled and comfortable way. In particular, the back of the seat does not flip back up into an upright position in an unpleasant manner.

The seat tilting mechanism 1 shown in the figures can be used in isolation with an office chair or the like, but two can also be provided, one on either side of an office chair, to provide greater stability.

The present invention can be altered without departing from the scope of claim 1. In particular, as shown in FIG. 4, the dual spring arrangement can be used in a simple seat tilting mechanism which does not feature any interrelationship between the seat and the backrest. In FIG. 4, seat tilting mechanism 100 comprises a main body 101, a support member in the form of lever 102 rotationally mounted to the main body 101, and a first extension coil spring 103 mounted between the main body 101 and the support member 102 to provide resistance to rotation of the support member 102. The seat tilting mechanism 100 further comprises a second extension coil spring 104 and an engagement mechanism, generally designated 105, which engages the second extension coil spring 104 for resistance to rotation of the support member 102 when the first extension coil spring 103 reaches a pre-determined point of extension. This is the position which is illustrated in FIG. 4.

The resistance to extension mechanism which comprises the first and second coil springs 103 and 104 is identical to that shown in seat tilting mechanism 1 described above. However, the lever 102 is a simplex rotational component which is mounted at a midpoint 106 by annular hinge 107 to the main body 101, and comprises a first portion 108 which is rotationally connected at an upper point 109 to first end part 110 by an annular hinge 111, and a second portion 112 rotationally connected at a lower point 113 by annular hinge 114 to backrest support 115.

In use a rotational force applied by a user to the backrest support 115 rotates the lever 102 about the midpoint 106. This rotational motion is resisted initially by just the first coil spring 103, and then once the first coil spring 103 reaches the pre-determined point of extension as shown in FIG. 4, and ring 116 engages annular flange 117, the rotational motion is resisted by both the first coil spring 103 and the second coil spring 104. This additional resistance to extension counteracts the increase in the driving force applied by the user as they shift more of their weight onto the backrest support 115 the further back they lean. The extra resistance provided by the second coil spring 104 helps to prevent, or at least mitigate against, an uncontrollable increase in the rate of tilting rotation after the mid-tilt position. This makes for a more comfortable seating experience.

In another alternative embodiment (not shown) the second coil spring is mounted independently of the first, and the engagement mechanism involves a physical part of the first coil spring or the support member physically engaging the second coil spring.

In another alternative embodiment (not shown) the first and second coil springs are mounted in parallel with one another, rather than co-axially.

In another alternative embodiment (not shown) the whole extension resistance mechanism is mounted the opposite way up to in seat tilting mechanism 1, with the first end part mounted to the main body, and the second end part mounted to the lever.

In another alternative embodiment (not shown), instead of using a ring and a flange to provide the engagement mechanism, the spacer member is provided with a radially extending pin, and the first end part comprises a sleeve with an axially extending slot in which the pin is disposed. In the rest position the pin is located at a first end of the slot, and at the pre-determined point of extension the pin is located at a second end of the slot, and the first end part and the spacer member are linked for extension of the second coil spring.

Therefore, the present invention provides a resistance to rotation which beneficially increases at the pre-determined point of extension. As outlined above, this can help to provide a more user-friendly seating experience, because the seat can be easy to tilt at first, but is controlled as the weight of the user is shifted more and more onto the backrest.

The invention claimed is:

1. A seat tilting mechanism comprising a main body, a support member rotationally mounted to said main body, and a first extension coil spring mounted between said main body and said support member to provide resistance to rotation of said support member, and in which said seat tilting mechanism further comprises a second extension coil spring and an engagement mechanism which engages said second extension coil spring for resistance to rotation of said support member when said first extension coil spring reaches a pre-determined point of extension.

2. A seat tilting mechanism as claimed in claim 1 in which said seat tilting mechanism comprises an extension resistance mechanism comprising a first end part, a second end part and said first extension coil spring and second extension coil spring mounted between said first end part and said second end part.

3. A seat tilting mechanism as claimed in claim 2 in which said second extension coil spring comprises an axially extending spacer member mounted to a first end thereof, in which said engagement mechanism comprises a first radially extending portion provided at a first end of said spacer member and a second radially extending portion provided on said first end part, and in which said second radially extending portion engages said first radially extending portion when said first extension coil spring reaches said pre-determined point of extension.

4. A seat tilting mechanism as claimed in claim 3 in which said second extension coil spring is co-axial with said first extension coil spring.

5. A seat tilting mechanism as claimed in claim 4 in which said second extension coil spring and is mounted inside said first extension coil spring.

6. A seat tilting mechanism as claimed in claim 5 in which said spacer member comprises a sleeve with an annular flange at said first end, in which said first end part comprises a ring mounted around said sleeve, which abuts against said flange when said first extension coil spring reaches said pre-determined point of extension.

7. A seat tilting mechanism as claimed in claim 6 in which said first end part comprises a rod arranged inside said sleeve for telescoping movement in relation thereto.

8. A seat tilting mechanism as claimed in claim 7 in which said first end part is mounted to said support member and said second end part is mounted to said main body.

9. A seat tilting mechanism as claimed in claim 1 in which said support member comprises a seat support.

10. A seat tilting mechanism as claimed in claim 1 in which said support member comprises a backrest support.

11. A seat tilting mechanism as claimed in claim 1 in which said support member comprises a lever rotationally mounted at a midpoint thereof to said main body, and comprising a first portion rotationally mounted at an upper point of said lever to a seat support, and a second portion rotationally mounted at a lower point of said lever to a backrest support, in which said seat tilting mechanism comprises an articulation mechanism comprising a first arm, a first end of which is rotationally mounted to said main body and a second end of which is rotationally mounted to said seat support, said first arm defining with said first portion, said seat support and said main body a first quadrilateral hinge, in which said articulation mechanism comprises a second arm, a first end of which is rotationally mounted to said main body and a second end of which is rotationally mounted to said backrest support, said second arm defining with said second portion, said backrest support and said main body a second quadrilateral hinge, in which interior corner angles and lengths of each side of said first quadrilateral hinge, and interior corner angles and lengths of each side of said second quadrilateral hinge are such that a predetermined angular displacement ratio of said backrest support in relation to said seat support is provided, in which said extension resistance mechanism is mounted between said main body and said first portion to provide resistance to rotation of said lever, in which said first end part is rotationally mounted to said lever at a first mounting point located between said midpoint and said upper point, and in which said first end part is angularly displaced from a line extending between said midpoint and said upper point.

12. A seat tilting mechanism as claimed in claim 11 in which said first quadrilateral hinge is movable between a rest position in which said seat support is substantially horizontal, and a fully tilted position in which said seat support is angularly displaced from horizontal, in which said second end part is rotationally mounted to said main body at a second mounting point, in which said first mounting point is located such that a rotation angle between an axis of said extension resistance mechanism and a line extending between said second mounting point and said upper point decreases as the first quadrilateral hinge moves from said rest position towards said fully tilted position.

13. A seat tilting mechanism as claimed in claim 12 in which said first extension coil spring reaches said pre-determined point of extension before said rotation angle reaches zero.

14. A seat tilting mechanism as claimed in claim 13 in which said first mounting point is located such that said rotation angle is zero prior to said first quadrilateral hinge achieving said fully tilted position.

15. A seat tilting mechanism as claimed in claim 14 in which said interior corner angles and said lengths of each side of said first quadrilateral hinge, and said interior corner angles and said lengths of each side of said second quadrilateral hinge are such that said predetermined angular displacement ratio of said backrest support in relation to said seat support is greater than one to one and less than two to one.

16. A seat tilting mechanism as claimed in claim 15 in which said interior corner angles and said lengths of each side of said first quadrilateral hinge, and said interior corner angles and said lengths of each side of said second quadrilateral hinge are such that said predetermined angular displacement ratio of said backrest support in relation to said seat support is substantially 1.9 to one.

17. A seat tilting mechanism as claimed in claim 8 in which said support member comprises a seat support.

18. A seat tilting mechanism as claimed in claim 17 in which said support member comprises a backrest support.

19. A seat tilting mechanism as claimed in claim 18 in which said support member comprises a lever rotationally mounted at a midpoint thereof to said main body, and comprising a first portion rotationally mounted at an upper point of said lever to a seat support, and a second portion rotationally mounted at a lower point of said lever to a backrest support, in which said seat tilting mechanism comprises an articulation mechanism comprising a first arm, a first end of which is rotationally mounted to said main body and a second end of which is rotationally mounted to said seat support, said first arm defining with said first portion, said seat support and said main body a first quadrilateral hinge, in which said articulation mechanism comprises a second arm, a first end of which is rotationally mounted to said main body and a second end of which is rotationally mounted to said backrest support, said second arm defining with said second portion, said backrest support and said main body a second quadrilateral hinge, in which interior corner angles and lengths of each side of said first quadrilateral hinge, and interior corner angles and lengths of each side of said second quadrilateral hinge are such that a predetermined angular displacement ratio of said backrest support in relation to said seat support is provided, in which said extension resistance mechanism is mounted between said main body and said first portion to provide resistance to rotation of said lever, in which said first end part is rotationally mounted to said lever at a first mounting point located between said midpoint and said upper point, and in which said first end part is angularly displaced from a line extending between said midpoint and said upper point.

20. A seat tilting mechanism as claimed in claim 19 in which said first quadrilateral hinge is movable between a rest position in which said seat support is substantially horizontal, and a fully tilted position in which said seat support is angularly displaced from horizontal, in which said second end part is rotationally mounted to said main body at a second mounting point, in which said first mounting point is located such that a rotation angle between an axis of said extension resistance mechanism and a line extending between said second mounting point and said upper point decreases as the first quadrilateral hinge moves from said rest position towards said fully tilted position.

* * * * *